US007474274B2

(12) United States Patent
Matsuhira et al.

(10) Patent No.: US 7,474,274 B2
(45) Date of Patent: Jan. 6, 2009

(54) DISPLAY DEVICE AND ELECTRONIC DEVICE USING THE SAME

(75) Inventors: Tsutomu Matsuhira, Chiba (JP); Hiroki Hanawa, Chiba (JP); Nobuyuki Sasaki, Chiba (JP); Hideaki Adachi, Chiba (JP)

(73) Assignee: Seiko Instruments Inc. (JP)

( * ) Notice: Subject to any disclaimer, the term of this patent is extended or adjusted under 35 U.S.C. 154(b) by 564 days.

(21) Appl. No.: 10/960,167

(22) Filed: Oct. 7, 2004

(65) Prior Publication Data

US 2005/0174300 A1 Aug. 11, 2005

(30) Foreign Application Priority Data

Oct. 8, 2003 (JP) ..... 2003-349173
Oct. 4, 2004 (JP) ..... 2004-291522

(51) Int. Cl.
*G09G 5/00* (2006.01)

(52) U.S. Cl. ..... 345/1.1; 345/169; 345/211

(58) Field of Classification Search ..... 345/1.1–1.3, 345/169, 87, 211, 97, 89, 102, 98–100
See application file for complete search history.

(56) References Cited

U.S. PATENT DOCUMENTS

| | | | | |
|---|---|---|---|---|
| 5,670,970 | A * | 9/1997 | Yamazaki | 345/8 |
| 5,841,431 | A * | 11/1998 | Simmers | 345/211 |
| 5,881,299 | A * | 3/1999 | Nomura et al. | 713/324 |
| 6,917,359 | B1 * | 7/2005 | Nanba et al. | 345/211 |
| 7,088,355 | B1 * | 8/2006 | Ochi | 345/211 |
| 7,089,040 | B2 * | 8/2006 | Iwabuchi et al. | 455/566 |
| 2006/0077116 | A1 * | 4/2006 | Chen et al. | 345/1.1 |

* cited by examiner

*Primary Examiner*—Duc Q Dinh
(74) *Attorney, Agent, or Firm*—Adams & Wilks

(57) ABSTRACT

A display device of the present invention switches between two displays, a main panel display and a sub-panel display, by using one driver IC. Liquid crystals having different optimal driver voltages are used in the main panel and the sub-panel, and the optimal driver voltage for the panel in which display is to be performed is output. A driver voltage that is higher or lower than the optimal driver voltage is applied to the display panel where display is not to be performed, and the entire display thereof displays a single color. Display content of the panel on which display is not to be performed cannot be identified.

20 Claims, 4 Drawing Sheets

FIG. 8
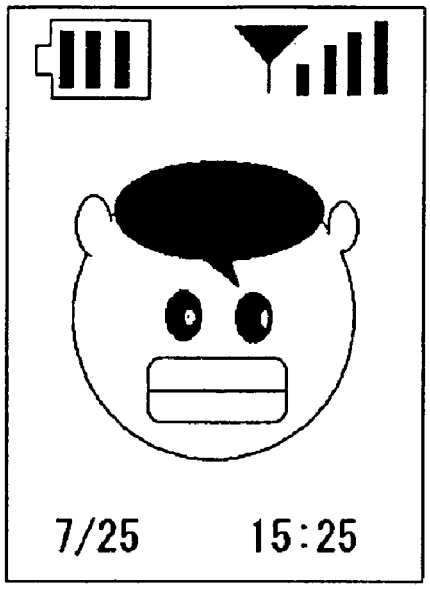
FIG. 9
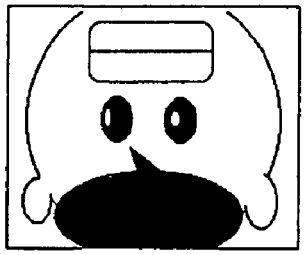
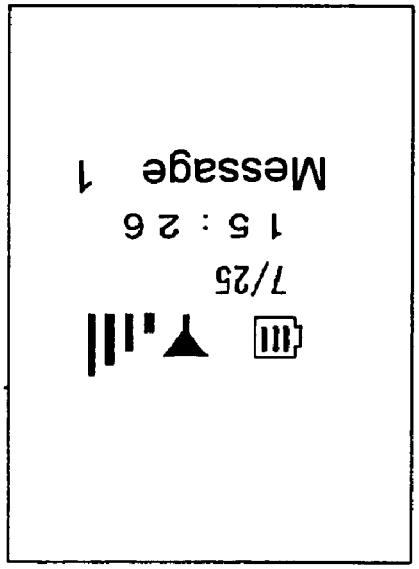
FIG. 10
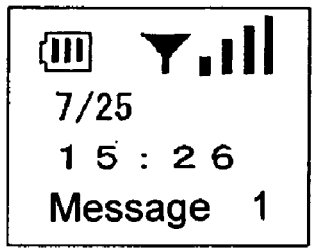
FIG. 11

DISPLAY DEVICE AND ELECTRONIC DEVICE USING THE SAME

BACKGROUND OF THE INVENTION

The present invention relates to a display device equipped with a double sided panel in which display panels such as passive matrix liquid crystal panels, active matrix liquid crystal panels, and organic EL panels are disposed on both sides of the display device. The present invention also relates to an electronic device such as a cellular telephone that uses the display device.

In a conventional display device, for example, an STN liquid crystal display device, segmented electrodes and common electrodes are arranged in a matrix shape, forming a dot matrix. An orientation film of polyimide or the like is formed on a surface of each of the electrodes, and a liquid crystal layer is provided between the electrode surface and the orientation film. A screen is driven by applying voltage to each of the electrodes in a time division manner. Segmented signals and common signals differ from each other. An output electrode of a driver IC is connected to each of the electrodes that configure the dot matrix, and the driver IC applies signals. One chip is used to configure the driver IC that outputs the segmented signals and the common signals when the number of pixels is on the order of 160×128 dots. When the number of pixels is greater than 160×128 dots, however, specialized drivers are used as the driver IC for the segmented signals and the common signals. A plurality of driver ICs may also be used depending upon the relationship between the number of output driver signals from the driver ICs and the number of pixels.

Clamshell type structures that open into two parts have been widely employed in cellular telephones in recent years. Particular structures in which a main screen and a rear surface sub-screen are installed as display screens so that the two screens perform display on both sides of the cellular phone (hereinafter called a double sided panel) have been increasing. The two screens are configured by using separate display panels (refer to JP 2000-338483 A, for example). Separate ICs for driving the display panels are respectively mounted to the display panels to drive both of the screens. Alternatively, there is also a method of driving the two screens by using one driver IC corresponding to the combined number of pixels of both display screens. When the STN liquid crystal display devices are used in this method, for example, the segmented signals are drawn out from a side that is opposite to a side connected to the main display panel. The main display panel is connected to the sub-display panel by a film substrate to share the segmented signals. Further, the common electrodes are disposed on both sides of connection terminals for the segmented signals. Dedicated signals used only for the sub-screen are connected to the main display panel on both sides of the common electrodes used by the main display panel. The dedicated signals used for the sub-screen are connected to the sub-display panel via an outer circumference of the main display panel, similar to the segmented signals, and thus drive both screens. Alternatively, with a method of branching off the signals output from the ICs at the terminals connected to the main display panel by, for example, connecting to the sub-display panel using a flexible substrate, the common signals can also be shared, not only the segmented signals.

Problems, however, exist with the double-sided panel driven by one chip sharing signals. That is the same signals are applied to the sub-display panel as those applied to the main display panel, and thus, the main display panel and the sub-display panel turn on at the same time. Other persons can therefore see the image displayed on the sub-display panel when the cellular telephone is being operated from the main display panel, and security is not maintained.

SUMMARY OF THE INVENTION

A display device of the present invention displays a single color such as all black or all white in a sub-display panel when displaying in a main display panel, effectively placing the display of the sub-display panel in an off state. In other words, liquid crystals having an optimal driver voltage that differs from the optimal driver voltage of the main display panel are used in the sub-display panel so that the sub-display panel becomes all black or all white when the main display panel is in use. Specifically, the liquid crystals used in the sub-display panel have properties such that the display of the sub-display panel is placed in an on state, or is placed in an off state, for both on signals and off signals used to drive the main display panel.

When the main display panel performs display, the display of the sub-display panel may be black. The display of the sub-display panel is placed in an on state when the main display panel performs display. In order to display black in the sub-display panel when the main panel performs display, a normally white mode where light passes in an initial state, and where the display becomes black when in an on state, may be employed. In addition, a normally black mode where light does not pass in an initial state, and where the display becomes white in an on state, may be employed in order to display black in the sub-display panel when the main panel performs display. Further, an attractive display panel can be obtained by performing control under the optimal driver conditions of both panels when the main panel and the sub-display panel are both in use.

BRIEF DESCRIPTION OF THE DRAWINGS

In the accompanying drawings:

FIG. 8 is an example of a main panel display when the cellular telephone is in an open state;

FIG. 9 is an example of a sub-panel display when the cellular telephone is in an open state;

FIG. 10 is an example of the main panel display when the cellular telephone is in a closed state;

FIG. 11 is an example of the sub-panel display when the cellular telephone is in a closed state.

DETAILED DESCRIPTION OF THE PREFERRED EMBODIMENTS

A display device according to the present invention includes a first display panel, a second display panel that has a different optimal driver voltage than that of the first display panel, and a driver IC that supplies driver signals in parallel to the first display panel and to the second display panel. The driver IC switches between output of a first driver signal having an optimal driver voltage for the first display panel and a second driver signal having an optimal driver voltage for the second display panel. The second display panel takes on a single color display over its entire screen when the first driver signal is output. For example, when the optimal driver voltage for the second display panel is less than the optimal driver voltage for the first display panel, and when the display mode of the second display panel is a normally white mode, the screen of the second display panel will display black when the first driver signal is input to both display panels. On the other hand, when the optimal driver voltage for the second display panel is greater than the optimal driver voltage for the first display panel, and when the display mode of the second display panel is a normally black mode, the screen of the second display panel will display white when the first driver signal is input to both display panels.

In addition, when the number of pixels differs between the first display panel and the second display panel, the first driver signal and the second driver signal are set so that the driver duty and the driver bias ratio will be optimal for the first display panel and for the second display panel, respectively.

Further, an electronic device of the present invention uses a display device having any of the configurations described above.

EMBODIMENTS

Figure 1:
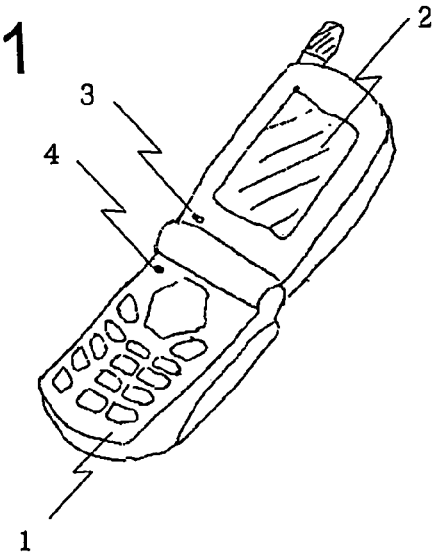
FIG. 1 is a perspective view of a front surface of a cellular telephone in an open state.
Figure 2:
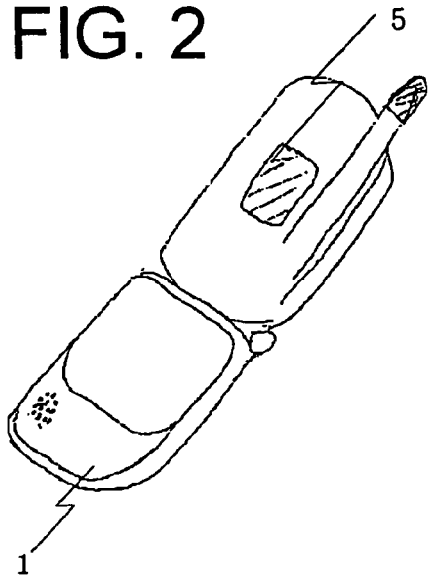
FIG. 2 is a perspective view of a rear surface of the cellular telephone in an open state.
Figure 3:
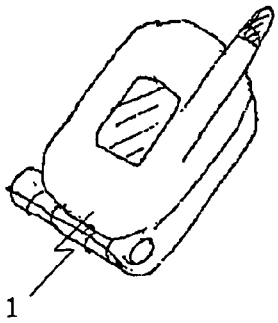
FIG. 3 is a perspective view of the cellular telephone in a closed state.

Embodiments of the present invention are explained below based on the appended drawings. FIG 1 is a perspective view of a portable electronic device in the form of a clamshell type cellular telephone in an open state. A cellular telephone 1 uses a main panel 2 in an open state. A projection 3 places a switch 4 in an on state when the cellular telephone 1 is in a closed state, while the switch 4 is in an off state when the cellular telephone 1 is open. A judgement can thus be made as to whether the cellular telephone 1 is in an open state or in a closed state. FIG. 2 is a perspective view of a rear surface side of the cellular telephone 1. A sub-panel 5 is disposed on the rear surface. FIG. 3 is a perspective view of the cellular telephone 1 in a closed state. The sub-panel 5 displays time, date, messages received, or calls received.

Figure 4:
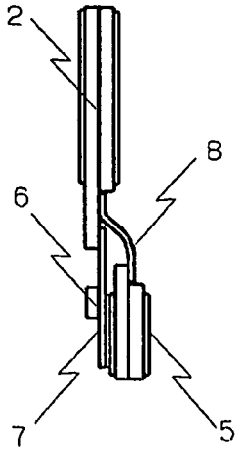
FIG. 4 is a side view of a partially finished double-sided panel module.
Figure 5:
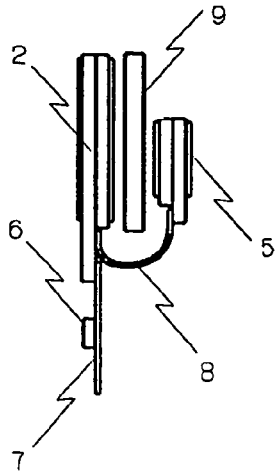
FIG. 5 is a side view of the double-sided panel module with an incorporated backlight.

FIG. 4 is a side view that shows a connection state between the main display panel and the sub-display panel of a double sided liquid crystal display module. A drive IC (integrated circuit) 6 is mounted on a first FPC (flexible printed circuit) 7, and is connected to the main display panel 2. A second FCP 8 extracts signals from the main display panel 2, and is connected to the sub-display panel 5. FIG. 5 is a side view of the double sided display module with an incorporated back light. A back light 9 that uses an LED (not shown) as a light source is disposed on a rear surface of the main display panel 2. The second FPC 8 connected to the sub-display panel 5 is disposed as bent. The back light is of a type that emits light to two sides.

Figure 6:
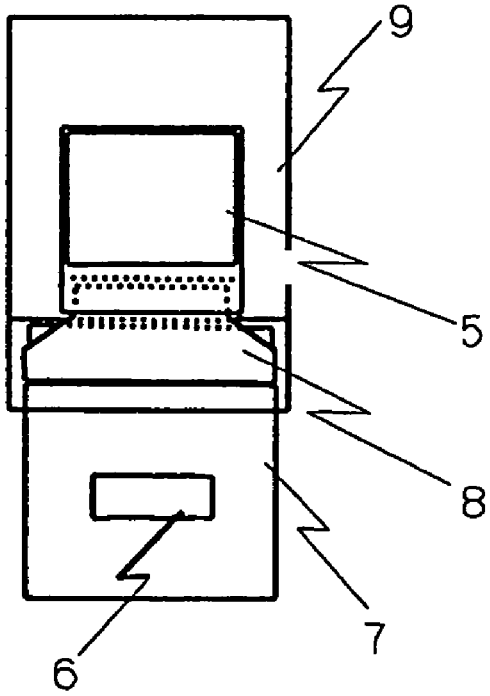
FIG. 6 is a front view of the double sided panel module with the incorporated back light as seen from a sub-panel side.
Figure 7:
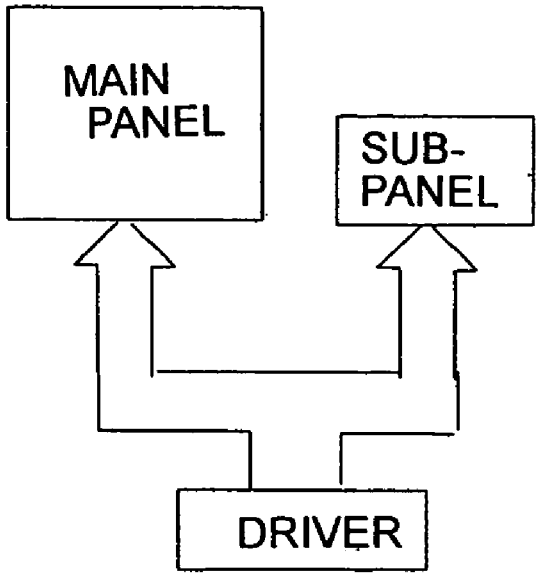
FIG. 7 is a conceptual diagram that shows a main panel, a sub-panel, and a driver IC in a connected state.

FIG. 6 is a front view of the liquid crystal display module as seen from the sub-display panel side. The sub-display panel is smaller in size than the main display panel. The main display panel is a normally black mode, 128 (RGB)×160 dot (pixel) transmissive type panel. The sub-display panel is a normally white mode, 64 (RGB)×96 dot (pixel) semi-transmissive type panel, and has a lower optimal driver voltage than the optimal driver voltage of the main display panel. FIG. 7 is a conceptual diagram that shows the main display panel, the sub-display panel, and wirings of the driver IC. The driver IC outputs 128×3 (RGB) segmented signals, and 160 common signals. In this embodiment, 64×3 (RGB) segmented signals and 96 common signals from among the signals output to the main panel are connected to the sub-display panel in parallel with the main display panel.

FIG. 8 is a display image of the main display panel when the cellular telephone is in an open state. The driver IC outputs signals at 1/160 duty, setting an optimal voltage for the main display panel. FIG. 9 is a display image of the sub-display panel when the cellular telephone is in an open state. The 1/160 duty driver voltage that is optimal for the main display panel is applied to the sub-display panel. Accordingly, the liquid crystals of the sub-display panel are placed in an on state whether the driver signal is an on signal or an off signal, and the entire screen or display area of the sub-display panel displays black.

FIG. 10 is a display image of the main panel when the cellular telephone is in a closed state. Although the main panel cannot be seen, the same voltage as the 1/96 duty optimal driver voltage for the sub-display panel is also applied to the main display panel, in portions where the main display panel and the sub-display panel are connected, when the sub-display panel is performing display. The optimal driver voltage of the main display panel is higher than the optimal driver voltage of the sub-display panel. Accordingly, the main display panel does not display anything, whether the optimal driver voltage of the sub-display panel is an on signal or an off signal. FIG. 11 is a display image of the sub-display panel when the cellular telephone is in a closed state. As described above, the sub-display panel is in an optimal image display state.

Figure 12:
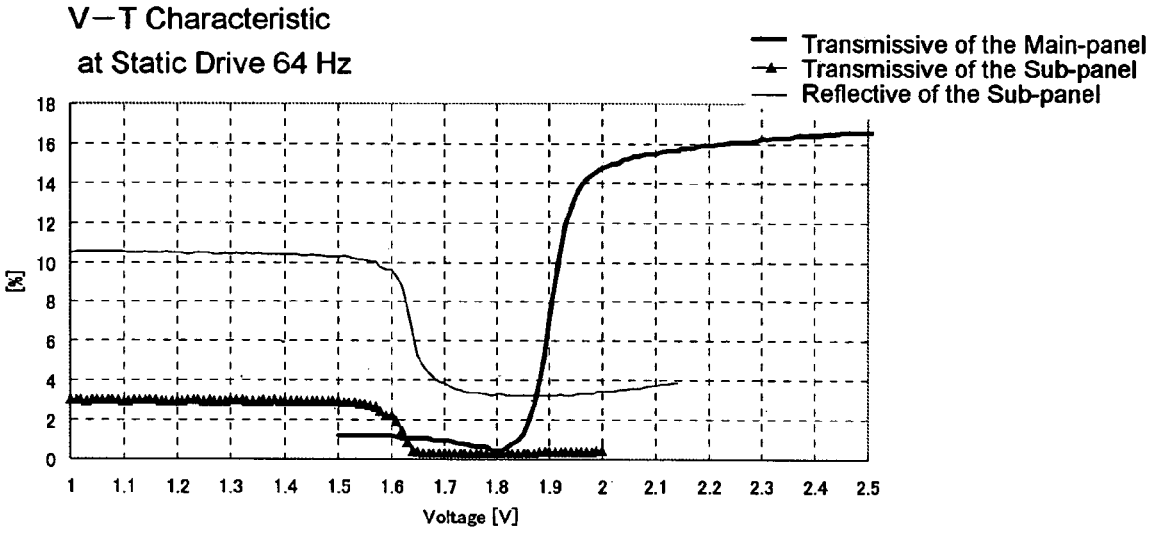
FIG. 12 is a graph of voltages applied to the main display panel and to the sub-display panel, and transmittances.

FIG. 12 is a graph of voltages of the main display panel and the sub-display panel, and light transmittances. The main display panel is a normally black mode display panel, and the sub-display panel is a normally white mode display panel. The liquid crystals in the main display panel turn on at 1.95 V, and turn off at 1.85 V. The sub-display panel is off from 1.85 V to 1.95 V. The liquid crystals in the sub-display panel turn on at 1.70 V, and turn off at 1.60 V. The main display panel is off from 1.60 V to 1.70 V. Accordingly, the sub-display panel is completely black when the main display panel performs display, and the main display panel is completely black when the sub-display panel performs display.

Switching between the two display panels can thus be performed by properly using the optimal driver voltages for the main display panel and the sub-display panel depending upon the state of the cellular telephone. Further, although the sub-display panel is a normally white mode display panel in this embodiment, it may also be a normally black mode display panel that uses liquid crystals having an optimal driver voltage that is higher than the optimal driver voltage of the main display panel.

As described above, according to the present invention, switching can be accomplished between a main display panel and a sub-display panel according to output driver voltages when the main display panel and the sub-display panel are connected in parallel to one driver IC. In addition, the main display panel and the sub-display panel can each perform display under optimal driver conditions. Consequently, a driver IC and peripheral components used for the sub-display panel, which are needed for conventional double sided displays having equivalent quality, become unnecessary. A low cost double sided display device can therefore be provided. Further, space is obtained by reducing the number of components. For example, the degree of freedom available for product design increases, such as that for arranging a camera module and making the sub-display panel larger in size, and an attractively finished product can be provided.

What is claimed is:

1. A display device, comprising:

a first display panel having first liquid crystals held between substrates;

a second display panel having second liquid crystals held between substrates, an optimal driver voltage of the second liquid crystals being different from that of the first liquid crystals of the first display panel; and a driver integrated circuit that selectively switches between a first driver signal and a second driver signal and supplies the selected driver signal in parallel to the first display panel and to the second display panel, wherein the first driver signal has an optimal driver voltage for the first display panel and the second driver signal has an optimal driver voltage for the second display panel, and wherein the second display panel exhibits a single color display over its entire display area when the first driver signal is supplied in parallel to the first display panel and to the second display panel.

2. A display device according to claim 1, wherein the optimal driver voltage for the second display panel is less than the optimal driver voltage for the first display panel, and a display mode of the second display panel is a normally white mode.

3. A display device according to claim 1, wherein the optimal driver voltage for the second display panel is greater than the optimal driver voltage for the first display panel, and a display mode of the second display panel is a normally black mode.

4. A display device according to claim 1, wherein the number of pixels differs between the first display panel and the second display panel, and the first driver signal and the second driver signal are set to have different driver duties and driver bias ratios from each other.

5. An electronic device having a display device according to claim 1.

6. An electronic device according to claim 5, wherein the optimal driver voltage for the second display panel is less than the optimal driver voltage for the first display panel, and a display mode of the second display panel is a normally white mode.

7. An electronic device according to claim 5, wherein the optimal driver voltage for the second display panel is greater than the optimal driver voltage for the first display panel, and a display mode of the second display panel is a normally black mode.

8. An electronic device according to claim 7, wherein the number of pixels differs between the first display panel and the second display panel, and the first driver signal and the second driver signal are set to have different driver duties and driver bias ratios from each other.

9. An electronic device according to claim 5, wherein the electronic device is a cellular telephone.

10. An electronic device according to claim 9, wherein the first display panel and the second display panel are located on opposite sides of the cellular telephone.

11. A display device comprising: a first display panel having first liquid crystals held between opposed substrates and having an array of first pixels; a second display panel having second liquid crystals held between opposed substrates and having an array of second pixels; and a driver integrated circuit that selectively switches between either first driver signals or second driver signals and that is connected to the first and second display panels to supply in parallel the first driver signals to the first display panel and at least some of the first driver signals to the second display panel and to supply in parallel the second driver signals to the first display panel and to the second display panel, wherein the first driver signals have voltage levels effective to drive the first pixels to on and off states but ineffective to drive the second pixels, and the second driver signals have voltage levels effective to drive the second pixels to on and off states but ineffective to drive the first pixels.

12. A display device according to claim 11; wherein the number of first pixels is greater than the number of second pixels.

13. A display device according to claim 11; wherein the display device is a double-sided display device having the first display panel on one side thereof and the second display panel on the other side thereof.

14. A display device according to claim 11; wherein the first driver signals comprise on voltage signals and off voltage signals for turning on and off the first pixels, and the second driver signals comprise on voltage signals and off voltage signals for turning on and off the second pixels, the voltage levels of the on and off voltage signals of the first driver signals both being either higher or lower than the voltage levels of the on and off voltage signals of the second driver signals.

15. A display device according to claim 11; wherein the number of first pixels is different from the number of second pixels, and the first driver signals have a different driver duty and a different driver bias ratio from those of the second driver signals.

16. A portable electronic device having a display device according to claim 11.

17. A portable electronic device having a display device according to claim 16; wherein the electronic device is a cellular telephone.

18. A portable electronic device having a display device according to claim 17; wherein the first display panel and the second display panel are located on opposite sides of the cellular telephone.

19. A portable electronic device having a display device according to claim 18; wherein the number of first pixels is different from the number of second pixels, and the first driver signals have a different driver duty and a different driver bias ratio from those of the second driver signals.

20. A portable electronic device having a display device according to claim 16; wherein the display device is a double-sided display device having the first display panel on one side thereof and the second display panel on the other side thereof.

* * * * *